US005461219A

United States Patent [19]

Cronvall

[11] Patent Number: 5,461,219

[45] Date of Patent: Oct. 24, 1995

[54] APPARATUS AND METHOD FOR AUTOMATED PRINTING, READING, AND DIVIDING OF INFORMATION-CARRYING DOCUMENTS

[75] Inventor: Leif Cronvall, Kivik, Sweden

[73] Assignee: Texas Instruments Incorporated, Dallas, Tex.

[21] Appl. No.: 74,864

[22] PCT Filed: Dec. 18, 1991

[86] PCT No.: PCT/SE91/00874

§ 371 Date: Jun. 11, 1993

§ 102(e) Date: Jun. 11, 1993

[87] PCT Pub. No.: WO92/11613

PCT Pub. Date: Jul. 9, 1992

[30] Foreign Application Priority Data

Dec. 19, 1990 [SE] Sweden ..... 9004054

[51] Int. Cl.[6] ..... G07B 1/00

[52] U.S. Cl. ..... 235/384; 235/480; 235/375

[58] Field of Search ..... 235/489, 458, 235/449, 384, 493, 480, 475; 271/273, 275

[56] References Cited

U.S. PATENT DOCUMENTS

| | | | |
|---|---|---|---|
| 3,661,383 | 5/1972 | Morrison | 271/273 |
| 4,288,688 | 9/1981 | Kiyama et al. | 235/384 |
| 4,613,747 | 9/1986 | McCarthy | 235/480 |
| 4,704,518 | 11/1987 | Brunn et al. | 235/480 |
| 4,866,256 | 9/1989 | Morofushi | 235/449 X |
| 5,133,615 | 7/1992 | Saito et al. | 400/621 |
| 5,163,671 | 11/1992 | Walters | 271/186 |
| 5,179,272 | 1/1993 | Ono et al. | 235/480 X |
| 5,268,561 | 12/1993 | Kimura et al. | 235/449 X |

FOREIGN PATENT DOCUMENTS

| | | |
|---|---|---|
| 0132393 | 1/1985 | European Pat. Off. . |
| 1198718 | 7/1970 | United Kingdom . |

*Primary Examiner*—John Shepperd

*Attorney, Agent, or Firm*—Ronald O. Neerings; James C. Kesterson; Richard L. Donaldson

[57] ABSTRACT

An apparatus and method for automatically printing, reading and otherwise treating an information-carrying document, particularly apparatus having a mechanically dividable circular pathway for reading and otherwise processing ATB-ticket (Automated Ticket/Boarding document) at airport passenger gates, so-called gate readers (8), and a method in which such apparatus is used. The gate reader (8) includes a simple, dividable ticket cylinder (16) which lacks a casing and which includes a drive motor (9A), drive belts (9B, 9C), a first cog wheel (9D) which is firmly mounted on the body of the gate reader (8) and which functions to drive a second cog wheel (9E) mounted on one side of the drive wheel (22) and concentrical with the drive shaft (21). For the purpose of discharging separated ticket parts, the gate reader (8) is also provided with ticket switching devices (17A, 17B, 17C, 17D, 17E) of particular construction and mounted in a particular manner, and also with means for dividing an ATB-ticket (1) into its separate parts.

37 Claims, 5 Drawing Sheets

APPARATUS AND METHOD FOR AUTOMATED PRINTING, READING, AND DIVIDING OF INFORMATION-CARRYING DOCUMENTS

BACKGROUND AND SUMMARY OF THE INVENTION

The present invention relates to apparatus and to a method for automatically printing, reading and otherwise processing information-carrying documents, and relates particularly to apparatus having a mechanically dividable, circular document passageway for reading and otherwise processing ATB-tickets (Automated Ticket/Boardingpass documents) at airport gates, called gate readers, and a method which involves the use of such apparatus.

Tickets which include data inserted on an information carrier are used in several connections, e.g. in connection with airport passenger traffic, train traffic and bus traffic facilities, among others. Other possible areas of use include hotel and conference activities, ski-lifts, multi-story car-parks, various kinds of subscriber services, and other forms of activity which require the automatic processing of the data that has been entered on an information carrier or record medium. The tickets, or passes, concerned may have mutually different configurations, and may consist of one or more mutually joined parts which are intended to be separated from one another in one of the ticket processing stages. The first of the data concerned is entered on the ticket when the ticket is issued to the ticket owner. Data may be thereafter removed, inserted and read. The information carrier may have different forms and may, e.g., consist of magnetic strips, bar codes, colour markings or holograms.

Normally, a large number of tickets are handled over a short period of time, for instance when checking-in at an airport, and consequently it is necessary that the ticket handling apparatus is able to handle the ticket irrespective of which end of the ticket is inserted into the apparatus first, and irrespective of which side of the ticket faces upwards when inserting said ticket into said apparatus. Furthermore, it shall also be possible to read the data or information on the tickets even though the data is entered onto the information carrier on different occasions and with the aid of different equipment. The discharge of the ticket from the apparatus, and also the discharge of those ticket parts which may have been separated from the main body of the ticket, shall be independent of the manner in which the ticket was inserted. The apparatus concerned must be very reliable in operation and must also be able to process the ticket quickly and also to handle the ticket without requiring complicated instructions in the process. In order to enable such apparatus to be moved readily between different places of use, such apparatus must also have small dimensions and be light in weight. It must also be possible to readily dismantle and service the apparatus in the event of a malfunction, and the apparatus must also be able to process and handle tickets which while being worn or acceptably defective in other respects are nevertheless authentic and correctly made out.

The present invention satisfies all of these requirements and desiderata in a manner not previously known and also circumvents those problem which have occurred with apparatus of the kind used hitherto.

A number of ticket handling apparatus of the aforementioned kind are known to the art. One such apparatus is described and illustrated in U.S. Pat No. 4,788,419. This apparatus includes a cylindrical feed drum which is rotatable in one direction and which includes a simple ticket switching or guiding device. A similar apparatus described in U.S. Pat. No. 4,704,518 includes a reversible drum with fixed ticket switching devices. Document dividers are known from GB 1,198,718, although this known document divider is not used together with a circular, ticket-feed passageway. U.S. Pat. No. 4,288,688, DE 2,115,171 and JP 60-247 794 teach feed drums which can rotate in one single direction and which coact with very simple ticket switching devices. EP 0 132 393 teaches a ticket-handling apparatus which includes a reversible drum. None of the aforementioned prior publications, however, teach technical solutions which lie close to the solutions afforded by the subject matter defined in the Claims of this application.

BRIEF DESCRIPTION OF THE DRAWINGS

The invention will now be described in more detail with reference to an exemplifying, non-limiting embodiment of the invention illustrated in the accompanying drawings, this embodiment pertaining to a gate reader for handling ATB-tickets, although it will be understood that the concept of the invention may be applied to other types of apparatus intended for corresponding treatment or processing of other types of tickets.

Each individual component is identified in the drawings solely by one and the same reference sign, even though the component is shown in several Figures.

DETAILED DESCRIPTION OF THE PREFERRED EMBODIMENT

Figure 1:
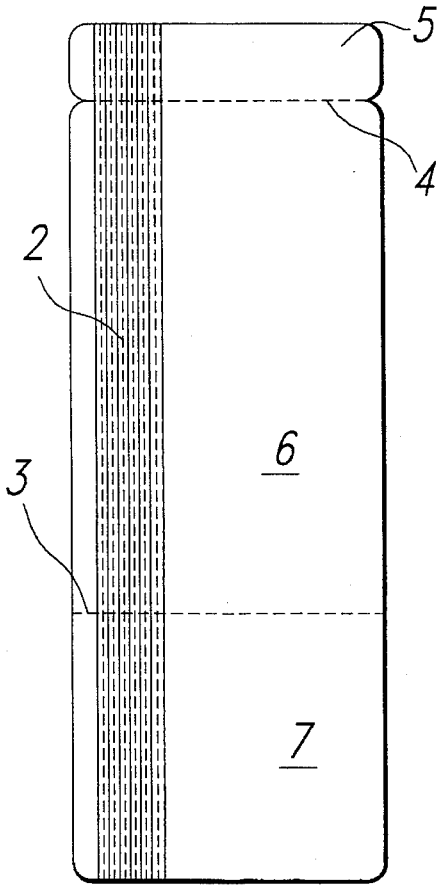
FIG. 1 illustrates schematically the reverse side of an ATB-ticket 1 which includes a magnetic strip 2 and a first set of perforations 3 and a second set of perforations 4, these sets of perforations dividing the ATB-ticket 1 into a binding stub 5, a flight coupon 6 and a boarding pass 7. Imperforate tickets, tickets which are provided with only one set of perforations or with more than two sets of perforations which extend at right angles to the longitudinal axis of the ticket can also be handled in apparatus which lie within the scope of the inventive concept as defined in this document.

The gate reader 8 operates as follows:

The gate reader 8 is positioned at the check-in desk of an airport, adjacent the gate through which passengers pass when boarding an aircraft. Each passenger arrives at the gate with his respective ATB-ticket 1—see FIG. 1. The ATB-ticket 1 consists of thin paperboard of well-defined thickness and stiffness and has a magnetic strip 2 provided on one side of the ticket. This magnetic strip 2 contains data relating to the name of the passenger, the aircraft flight number, the date, etc. The ticket 1 is normally provided with two sets of perforations 3 and 4 respectively, by means of which the ticket 1 can be divided into three separate parts. The smallest part is called the binding stub 5 and is used to join several ATB-tickets 1 together so as to form an integral unit. The centre part of the ticket is called the flight coupon 6 and during the subsequent processing of the ticket is fed to a storage unit as confirmation that the passenger has checked-in. The binding stub 5 is not normally separated from the main body of the ticket, but remains attached to the flight coupon 6. This latter part of the ticket 1 is called the boarding pass 7 and is retained by the passenger.

The side of the ATB-ticket 1 opposite to that side which carries the magnetic strip 2 is called the front side, and the other side is called the rear side. The front side of the ticket may contain printed information in clear text. Preferably, the flight coupon part 6 or the binding stub part 5 of the ATB-ticket 1 is inserted in to the apparatus first, the side of the ticket which faces upwards when the ticket is inserted being irrelevant. As will be evident from the following description, the gate reader 8 is able to handle the ATB-ticket 1 even when the ticket is inserted in a manner different to that preferred.

The gate reader 8 is controlled by a control system not shown.

Figure 17:
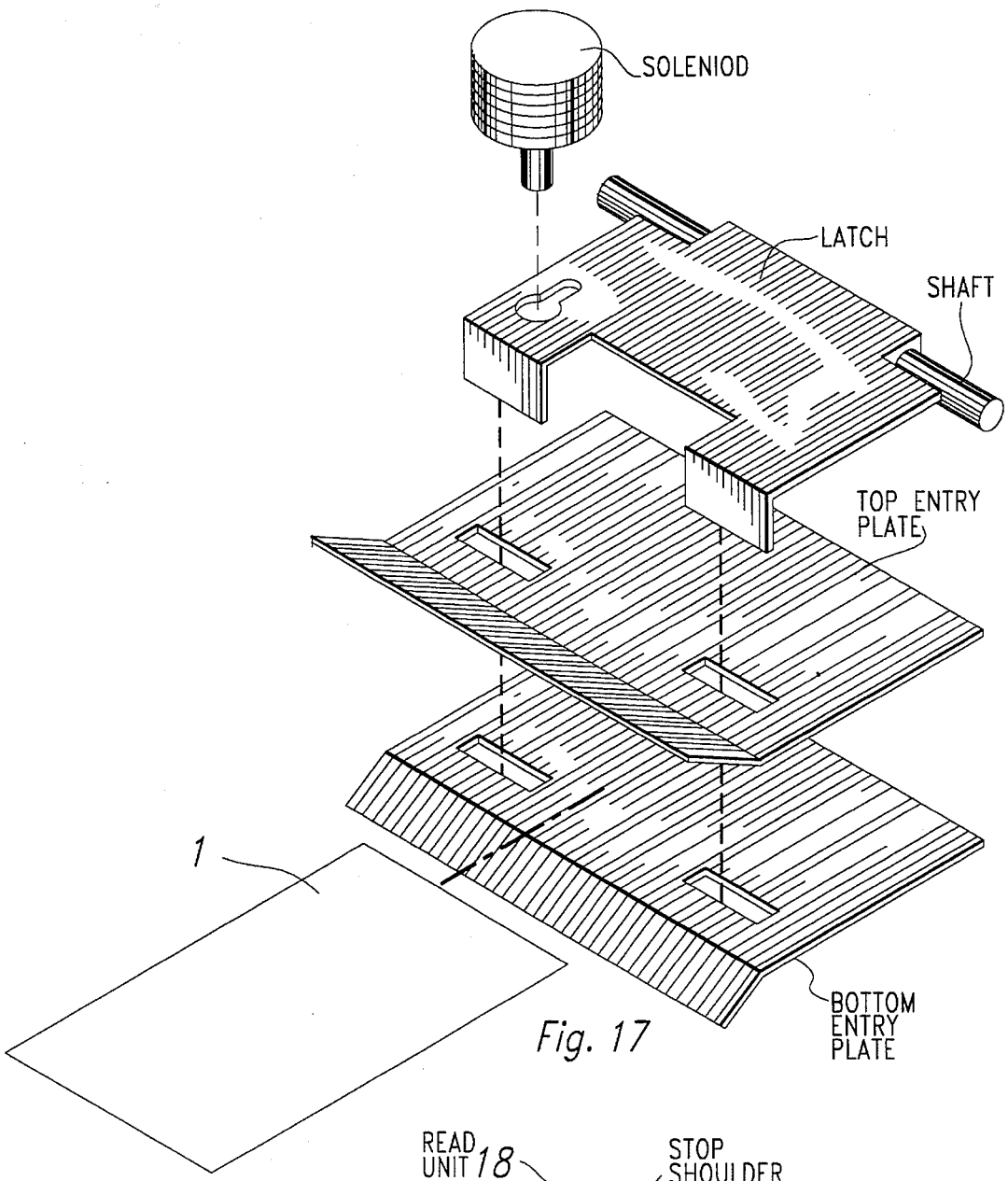
FIG. 17 is a partial exploded view of insertion opening 19 with latch.
Figure 18:
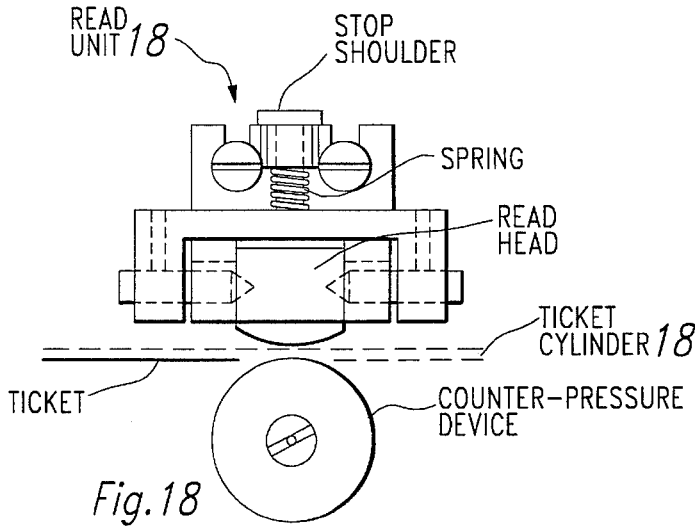
FIG. 18 is a side view of read unit 18.

This control system can be designed in a manner known to one skilled in this art and will therefore not be described in detail here. It can be mentioned, however, that the control system may advantageously be comprised of a local control system in the gate reader 8 which is subordinated to a main computer system. The ticket handling procedure is carried out in the following stages, described with references to FIGS. 2 and 3.

a) The gate reader 8 is in a standby state, in readiness for the insertion of a complete ATB-ticket 1 or some other authentic ticket, primarily a separate boarding pass 7. The ticket insertion opening 10 is provided with a latch, shown in FIG. 17, which prevents the insertion of a ticket into said opening when another ticket is being handled or processed by the gate reader 8 at that time. A complete ticket 1 is inserted at the first check-in gate, whereas a separate boarding pass 7 is inserted into a corresponding apparatus when the passenger checks in through a transit gate. The following description made with reference to ATB-tickets 1 will also apply, when appropriate, to other authentic tickets.

b) The working cycle of a gate reader 8 commences when an ticket 1 is present in the ticket insertion opening 10, and the ticket 1 is therewith transported into the gate reader 8.

c) The length of the ticket 1 is established so as to determine the type of document that has been inserted. If the length of the inserted ticket 1 does not coincide with a predetermined acceptable length, the ticket 1 is returned through the insertion opening 10.

d) If the length of the ticket 1 is acceptable, a start command is sent to the read unit 18 and the ticket 1 is fed past said unit. The data or information contained on the magnetic strip 2 is therewith read and used in the further processing of the ticket.

e) The main control system compares the information stored on the magnetic tape 2 with information earlier inserted into the main control system. For instance, this comparison may be made against a passenger list. If the result of this comparison is not satisfactory, the ticket 1 is returned to the insertion opening 10.

f) If the comparison is satisfactory, processing or handling of the ticket 1 continues, resulting in the discharge of the ticket, or parts thereof, through one of the ticket outfeed openings 11, 12 or 13. This continued treatment of the ticket is described herebelow with reference to steps g)–i).

When the gate reader 8 has completed its treatment of the ticket 1, the reader returns to its standby state.

A more detailed description of the construction and modus operandi of the gate reader 8 will now be given, primarily with reference to FIGS. 3–11.

The construction of the gate reader 8 is such that the ticket 1 is handled in a mechanically dividable or separable circular pathway which includes short ticket infeed and ticket outfeed paths, so that handling of the ticket can be effected rapidly. This construction results in a compact gate reader 8 with small external dimensions. The gate reader 8 is able to handle an ATB-ticket 1 irrespective of how the ticket is presented for insertion. The dividable ticket cylinder 16 and the read unit 18 are both comprised of physical and logical units which are controlled by separate microcomputer systems.

Figure 13:
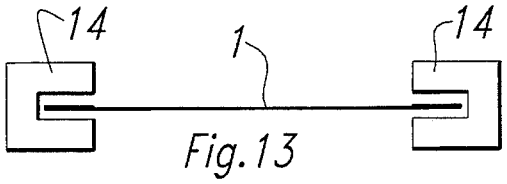
FIG. 13 is an end view of read forks 14.

When a voltage is applied to the gate reader 8, the dividable ticket cylinder 16 is first emptied automatically of those tickets which may have remained therein since an earlier voltage drop-off, together with any paper residues present. The gate reader 8 is then set to its standby state. When an ATB-ticket 1 is inserted through the ticket insertion opening 10, the ticket passes through the two read forks 14, shown in FIG. 13. In order for the ticket 1 to be considered correctly inserted, it is necessary for the two forks 14 to detect the ticket 1 simultaneously. Among other things, this will prevent the acceptance of a separate boarding pass 7 if the boarding pass is inserted in a position in which the magnetic strip 2 extends perpendicularly to the insertion direction of the boarding pass 7. The read forks 14 will also detect the insertion of a non-authentic document into the insertion opening 10.

Figure 14:
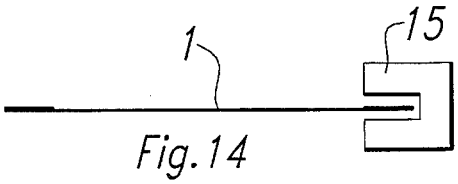
FIG. 14 is an end view of read fork 15.

The ATB-ticket 1 then passes through the read fork 15, shown in FIG. 14 which verifies that the ticket 1 has proceeded further into the gate reader 8. If the read fork 15 is not activated and/or not deactivated within a given, predetermined time period after starting of the drive motor 9A, the drive motor 9A is reversed so as to return the ticket 1 through the ticket insertion opening 10. If the read fork 15 is not activated and/or deactivated within a given time period, this will indicate that the ticket 1 has jammed or fastened, or has been withdrawn through the insertion opening 10.

The read fork 15 functions to measure the length of the ticket 1 by counting the number of pulses that are sent to the drive motor 9A advancing the ticket 1, from the time of activation of the read fork 15 by the leading edge of the ticket 1 to the time at which said fork 15 is deactivated by the trailing edge of said ticket 1. It will be understood that the length of the ticket can be measured in ways other than that described above. The length of the ticket is measured primarily in order to ascertain whether or not the ticket inserted is a complete ATB-ticket 1 or a separated boarding pass 7. The length measuring function is also used to prevent the insertion of erroneous tickets and irrelevant documents. When the length measured deviates markedly from the length found acceptable by the gate reader 8, the ticket 1 is returned through the ticket insertion opening 10. The ticket 1 is also returned should the ticket seize or fasten during the aforesaid length measuring process.

The ticket 1 is then moved into the ticket cylinder 16, in which it initially moves anti-clockwise. The read unit 18 reads the data on the magnetic strip 2 on the ticket 1 as said ticket passes the read heads in the read unit 18. Each of the read heads in the read unit 18 is resiliently mounted on the unit 18 in a manner such that a read head will be spaced from a corresponding counter-pressure device at a distance which is slightly smaller than the thickness of a ticket (1) when no ticket (1) is located between the read head and said corresponding counter-pressure device and which will be increased by a ticket (1) when said ticket passes between the read head and said corresponding counter-pressure device. The respective read heads are mounted, preferably with the aid of a stop shoulder, in a manner such that said distance cannot be made smaller than a predetermined value. In order to compensate for any obliqueness when mounting a read head, each read head is mounted, preferably with the aid of a cardan suspension, so that the side thereof facing said corresponding counter-pressure device will be plane parallel with the side of said device facing towards the read head.

As previously mentioned, the read unit 18 is able to read the magnetic strip 2 irrespective of how the ticket 1 is presented, i.e. which side of the ticket faces upwards when inserted through the opening 10. Subsequent to the ticket 1 having passed the read unit 18, movement of the ticket is stopped while the gate reader 18 awaits instructions from the aforesaid main control system.

If it has not been possible to read the data on the magnetic strip 2, the ticket is rotated anti-clockwise a maximum, predetermined number of times while re-reading said strip. The main control system will then issue instructions as to how future processing of the ticket 1 shall take place, these instructions being dependent on the data read from the magnetic strip 2.

During the processing of the ticket 1 and its respective parts, the read fork 20D functions to determined the location of the ticket 1 in the cylinder 16. The three read forks 20A, 20B, 20C function to confirm that all ticket-parts entering the ticket cylinder 16 have been discharged therefrom.

In order for the dividable ticket cylinder 16 to assist in fulfilling the requirements placed on the gate reader 8, it is necessary for the following to apply:

A. The outer diameter of the drive wheel 22 shall not be greater than that required for the ticket 1 to be afforded sufficient space in the mechanically dividable ticket cylinder 16.

B. The length dimension of the circular segment between two mutually sequential counter-pressure rollers 23, measured at their points of abutment with the drive wheel 22, shall be slightly shorter than the length of the shortest part that can be separated from the ticket 1. This shortest part will normally form the boarding pass 7.

C. The counter-pressure rollers 23 shall be positioned symmetrically around the drive wheel 22.

D. The number of counter-pressure rollers 23 provided is determined by the aforesaid conditions A, B and C.

E. The diameter of the counter-pressure rollers 23 shall, on the one hand, be sufficiently great to provide good abutment of the rollers with the ticket 1 and, on the other hand, sufficiently small to limit the outer measurements of the gate reader (8). However, the diameter of the rollers 23 must, under all circumstances, be sufficiently small to ensure that a ticket 1 which is discharged tangentially from the cylinder 16 will not strike against an adjacent roller 23, such ticket discharge always being effected between a counter-pressure roller 23 and the drive wheel 22.

The pitch diameter is defined as the diameter of the circle which passes through the centres of respective rollers 23. The pathway diameter is defined as the diameter of the circle followed by the median line of the ticket 1 in the cylinder 16.

The outer diameter is defined as the diameter of the imagined smallest cylinder in which the ticket cylinder 16 is accommodated.

For instance, when the ticket 1 is comprised of a so-called ATB 2-ticket, whose total length is approximately 203 mm, including a boarding pass 7 having a length of approximately 55 mm, the ticket cylinder 16 and adjacent components will preferably have the following sizes:

| | |
|---|---|
| Path diameter | 100 mm |
| Counter-pressure roller diameter | 15 mm |
| Pitch diameter | 115 mm |
| Outer diameter | 130 mm |
| Number of counter-pressure rollers 23 | 2 × 10 |

Figure 8:
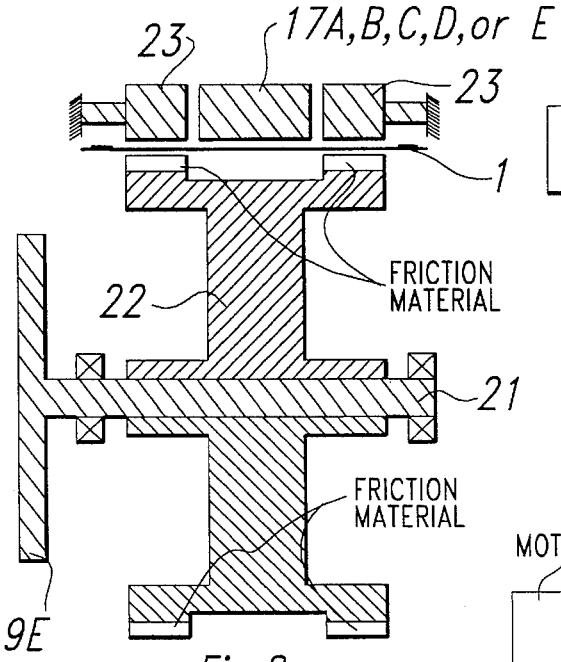
FIG. 8 is a sectional view of the drive wheel 22 taken through the drive shaft 21, and also illustrates one of the aforesaid ticket switching devices 17A, 17B, 17C, 17D or 17E, and the cog wheel 9E, which is provided with two peripheral friction linings.

2×8 number of rollers 23 are placed symmetrically around the drive wheel 22. Two of these rollers 23 are located at the position in which the ticket 1 is fed into the dividable ticket cylinder 16. 2×2 counter-pressure rollers 29 are positioned adjacent the infeed region of the read unit 18. As shown in FIG. 8, the drive wheel 22 has the form of two opposed H's when seen in cross-section. This configuration provides several advantages. Primarily, the configuration provides good stability when advancing the ticket 1 while greatly reducing the risk of bending the ticket 1 or buckling the corners thereof in a "dog-ear" fashion. Furthermore, the ticket switching devices 17A, 17B, 17C, 17D, 17E, hereinafter referred to simply a s switches, can be constructed so that direction changing of the ticket 1, as described in more detail herebelow, can be effected in a novel fashion and in a fashion which is a considerable improvement on earlier known apparatus. The peripheral surface on either side of the drive wheel 22 is provided, preferably by vulcanization, with a respective friction lining, preferably a polyurethane lining, against which the ticket 1 is pressed by the counter-pressure rollers 23. Each pair of rollers 23 is mounted on a common shaft, wherein the width of each roller is equal to the width of the aforesaid lining.

Figure 6:
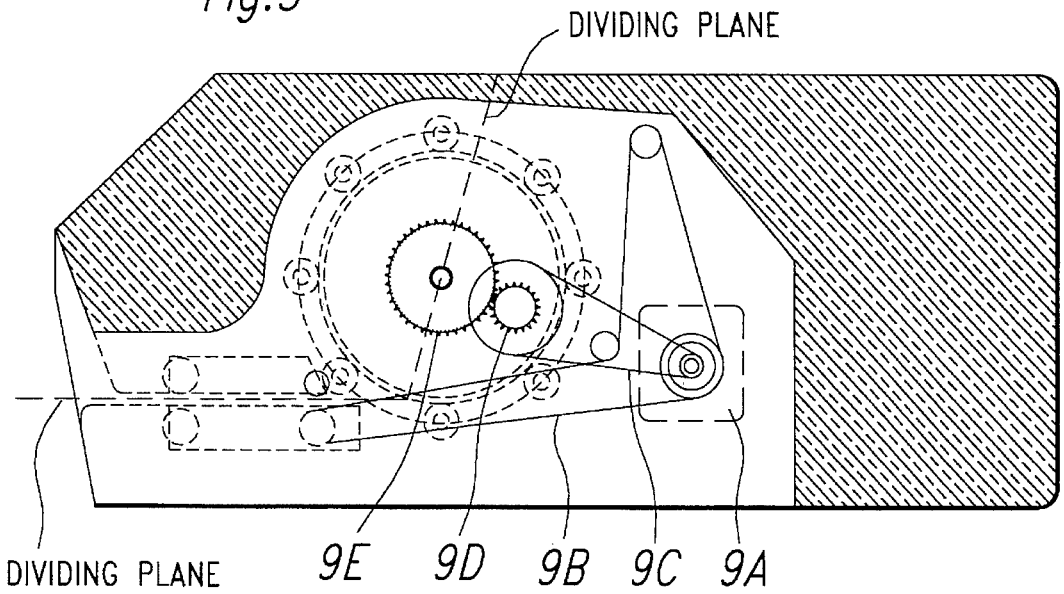
FIG. 6 is a side view, partly cut-away, of the gate reader 8 and illustrates the dividable ticket cylinder 16, a drive motor 9A, drive belts 9B, 9C mounted in the gate reader 8, and further illustrates a cog wheel 9D mounted on the body of said gate reader 8, and a cog-wheel 9E mounted on one side of the drive wheel 22 concentrical with the drive shaft 21.
Figure 7:
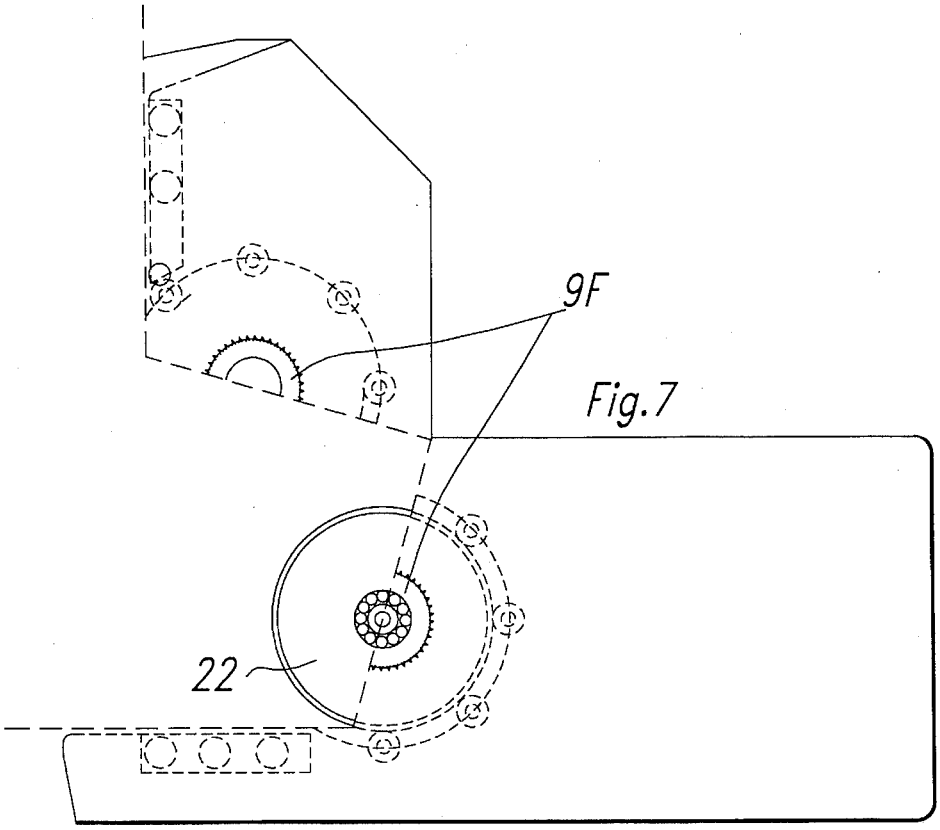
FIG. 7 is a side view of the gate reader 8 and illustrates an operational stage in which the dividable ticket cylinder 16 is open, and also illustrates a dividable bearing housing 9F.

In order to enable the gate reader 8 to be dismantled and serviced in the event of a malfunction, the reader 8 and its ticket cylinder 16 can be separated or divided in the manner illustrated in FIGS. 6 and 7. This separability is achieved by mounting the drive shaft 21 in a dividable bearing housing 9F and by mounting a number of the counter-pressure rollers 23 in a manner such that these rollers will accompany the liftable part of the reader 8. Subsequent to this separation, the drive wheel 21 together with the gear wheel 9E mounted therewith can be lifted from the reader 8.

Figure 15:
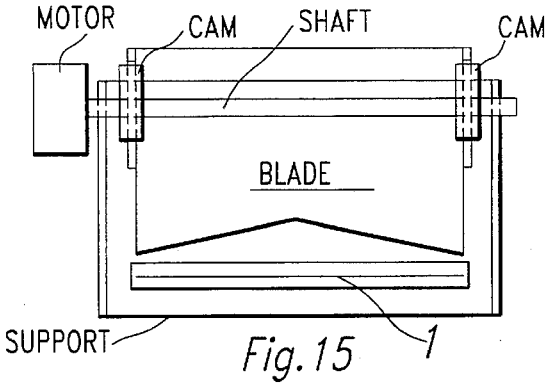
FIG. 15 is an end view of a document divider having only a few moveable parts, according to one embodiment of the invention.
Figure 16:
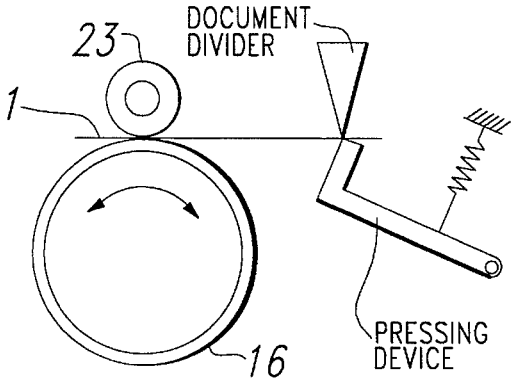
FIG. 16 is a side view of a document divider, according to another embodiment of the invention.

Known document dividers may include, for instance, shears and knives which all have the common feature that those components which effect division of the ticket are moveable. The document divider (19), however, is advantageously constructed with a stationary dividing edge parts, as shown in FIG. 16, or with moveable dividing edge parts, as shown in FIG. 15. The illustrated apparatus utilizes instead a facility in which the ticket (1) is moved backwards and forwards in the cylinder (16). In FIG. 16, document divider (19) is advantageously provided with, preferably, sharp dividing edge and has a pressing device, shown in FIG. 15 which is constructed so as to assist in separating the boarding pass (7) from the remaining part of the ticket (1) in the following manner:

A main control computer issues a command that the ticket (1) shall be divided, whereupon a part of the ticket is extended out of the cylinder (16) through a slot or some other opening located adjacent the aforesaid dividing edge of the document divider (19).

The ticket may be moved through the slot beth when the ticket (1) moves in a clockwise direction and when the ticket moves in an anti-clockwise direction in the cylinder (16).

Movement of the ticket through said slot is stopped when a pre-perforation, embossment or some other ticket dividing mark on the ticket (1) is located at the dividing edge of said document divider (19).

The ticket (1) is folded by means of said pressing device along said pre-perforation, embossment or like indication through an angle greater than 90° in a direction towards said dividing edge and is held in a folded state by means of the pressing device.

The ATB-ticket (1) is fed into the ticket cylinder (16) in a direction opposite to the direction in which part of said ticket was extended through said slot, said pre-perforation, embossment or like ticket-dividing indication being moved against said dividing edge such as to divide the ticket (1) at said pre-perforation, embossment or like ticket-dividing indication, said dividing edge preferably being angled so as to abut the pre-perforation, embossment or like ticket-dividing indication at only one single point which moves along said pre-perforation, embossment or like ticket-dividing indication as the ticket (1) is divided, so that division of said ticket into separate parts can be effected with the smallest possible force.

For the purpose discharging the ticket 1, or one of its parts, from the dividable ticket cylinder 16, a number of switches 17A, 17B, 17C, 17D, 17E are mounted adjacent the drive wheel 22. FIG. 8 is a sectional view of the drive shaft 21, the drive wheel 22 and one of the switches 17A, 17B, 17C, 17D or 17E.

A switch which is intended for use with the gate reader 8 must be constructed with great care. A switch which occupies its rest position shall not prevent movement of the ticket 1. Movement of a ticket switching device between its rest position and its working position shall be achieved in the simplest possible fashion and the extent of such movement shall be as small as possible. Furthermore, when in its working position, a switch shall function to guide the ticket 1 without causing the ticket to be torn to pieces or otherwise damaged, even when the ticket is not in a totally faultless condition. It will be noted in particular that guiding of a ticket over a switch shall not be impaired by the perforations on the ticket 1, even though the ticket 1 might have been folded along one of the perforations for instance, prior to reaching a switch. It is particularly important that the binding stub 5 will not hook-up on a switch. According to the present invention, the switches 17A, 17B, 17C, 17D, 17E fulfill these requirements in a particularly reliable and novel fashion.

Figure 9:
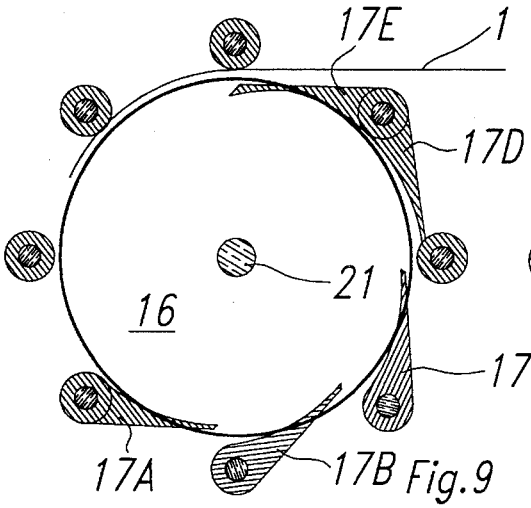
FIG. 9 is a side view which illustrates the ticket switching devices 17A, 17B, 17C, 17D, 17E and the dividable ticket cylinder 16 with all of said ticket switching devices being located in their rest positions.
Figure 10:
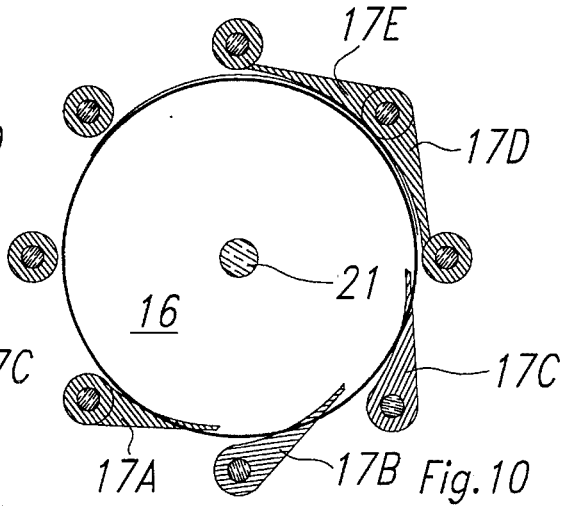
FIG. 10 is a side view which illustrates the ticket switching devices 17A, 17B, 17C, 17D, 17E and the dividable ticket cylinder 16 with the ticket switching device 17E in its operative working position and the remaining ticket switching devices in their respective rest positions.

FIGS. 9 and 10 are side views of the ticket cylinder 16 with the switches 17A, 17B, 17C, 17D, 17E in their respective rest and working positions.

Figure 11:
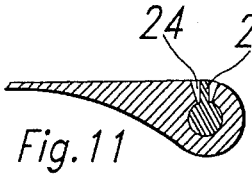
FIG. 11 is a longitudinal section view of one of the ticket switching devices 17A, 17B, 17C taken at right angles to the pivot axis of said ticket switching device, and also shows a spring 24.
Figure 12:
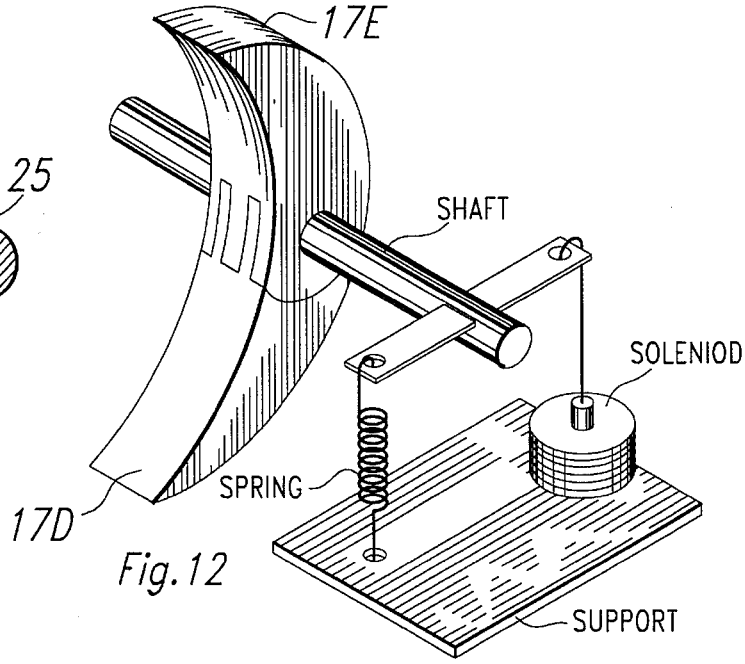
FIG. 12 is an external view of the ticket switching devices 17D, 17E, which are mounted on a common shaft.

FIG. 11 is a more detailed illustration of one of the mutually identical switches 17A, 17B, 17C. Each of the switches 17A, 17B, 17C has the shape of a wing cross-section, with the shaft of a counter-pressure roller 23 extending through the thickest part of the wing. As shown in FIG. 12, the two counter-directed switches 17D and 17E are mounted on one and the same counter-pressure roller shaft. The thickest part of each of the switches 17A, 17B, 17C, 17D, 17E projects slightly beyond its coacting roller 23, so that a ticket 1 which is fed along the upper side of a respective switch 17A, 17B, 17C, 17D or 17E will not come into contact with the roller 23, since the rotational direction of said roller is opposite to the rotational direction of the ticket 1. The undersides of respective switches 17A, 17B, 17C, 17D or 17E, i.e. the sides of the switches 17A, 17B, 17C, 17D or 17E which face towards the drive wheel 22 have generally the same radius dimension as the drive wheel 22. The length dimension of each of the switches 17A, 17B, 17C, 17D, 17E is such that when one of the switches 17A, 17B, 17C, 17D, 17E is rotated outwards away from the drive wheel 22, the thinner end of the switch will support against the nearest adjacent switch 17A, 17B, 17C, 17D, 17E, in a manner such that the underside of said switch will be concentrical with the drive wheel 22.

As shown in FIGS. 9 and 10, the read forks 14, 15, the switches 17A, 17B, 17C, 17D, 17E, the read unit 18, the read fork 20D and the counter-pressure rollers 23 together form a continuous and dividable outer path on which the ticket 1 moves.

When no ticket 1 rests against the underside of a switch 17A, 17B, 17C, 17D or 17E, this switch is in its rest position. When occupying its rest position, the thin end of the switch will be located inwardly of the mantle surface of the drive wheel 22. When the switch occupies its rest position, the ticket 1 can be fed clockwise from the cylinder 16 along the upper side of said switch. On the other hand, when a ticket 1 lies against the underside of said switch, the switch is in its working position, meaning that the underside of said switch is concentrical with the drive wheel 22. The precise working position of the switch is determined by the thickness of the ticket 1.

As will be seen from FIG. 11, the switches 17A, 17B, 17C are held in their respective rest positions by a spring 24, which may be incorporated in the thickest part of respective switches or may be mounted at one end, or at both ends, of the respective carrier shaft on which these switches are mounted. In the former case, in which the spring 24 is built into the thickest part of the switch, the spring 24 will support against a pin 25 which is firmly anchored in the pivot axle of the switch concerned. The spring 24 is compressed when the ticket 1 is pressed against the underside of the switch concerned, therewith moving said switch to its working position.

The switch 17E in FIG. 12 is held in its working position in principly the same manner as the switches 17A, 17B, 17C, with the difference that the spring 24, in this case, is mounted solely in connection with the axle supporting the switch 17E. It will also be seen from FIG. 12 that the switch 17D and the switch 17E are mounted on a common shaft which explains the aforesaid space deficiency. In distinction to the switches 17A, 17B, 17C, 17E, the switch 17D has an outwardly directed rest position, which is achieved with the aid of a spring. The inwardly directed working position of the switch 17D is achieved with a conventional magnet coil, shown in FIG. 12. Alternatively, the switch 17D and the switch 17E may be constructed as a single, inseparable unit.

In order for the aforedescribed switches 17A, 17B, 17C, 17D, 17E to function correctly, the radial depth of the space located between the aforedescribed friction linings on the drive wheel 22 shall at least be equal to the thickness of the ticket 1 plus the thickness of the thinnest part of the aforesaid switches 17A, 17B, 17C, 17D, 17E. This minimum depth is necessary, among other things, in order to enable the aforesaid thin part of a respective switch to be positioned beneath the ticket 1.

It is obvious that guide plates or the like which function to guide the ticket 1 towards adjacent counter-pressure rollers 23 may be suitably positioned between the counter-pressure rollers 23 at locations where no switch is found.

Figure 2:
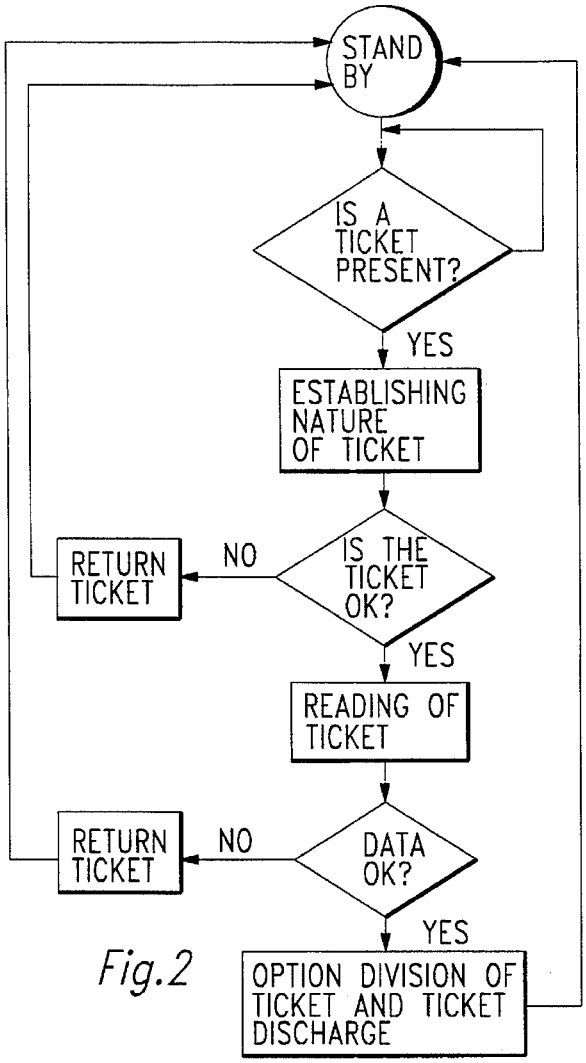
FIG. 2 is a block schematic overview which illustrates processing of an ATB-ticket 1 in a gate reader 8.
Figure 3:
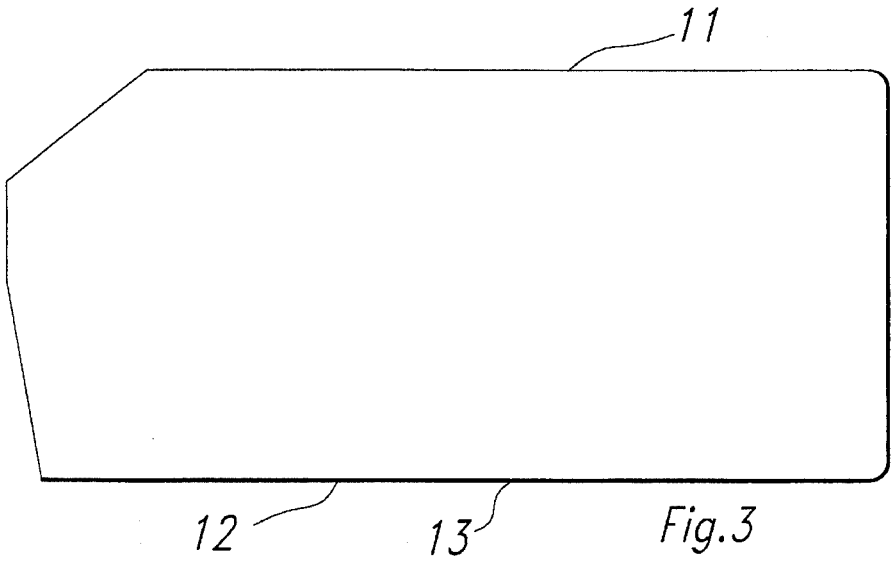
FIG. 3 is a schematic, external view of a gate reader 8 intended for handling or treating ATB-tickets 1, and includes a latchable or blockable ticket insertion opening 10 and three outfeed openings 11, 12 and 13. Two mutually different ticket outfeed pathways lead to the outfeed opening 11. One ticket outfeed path leads to each of the outfeed openings 12 and 13.
Figure 4:
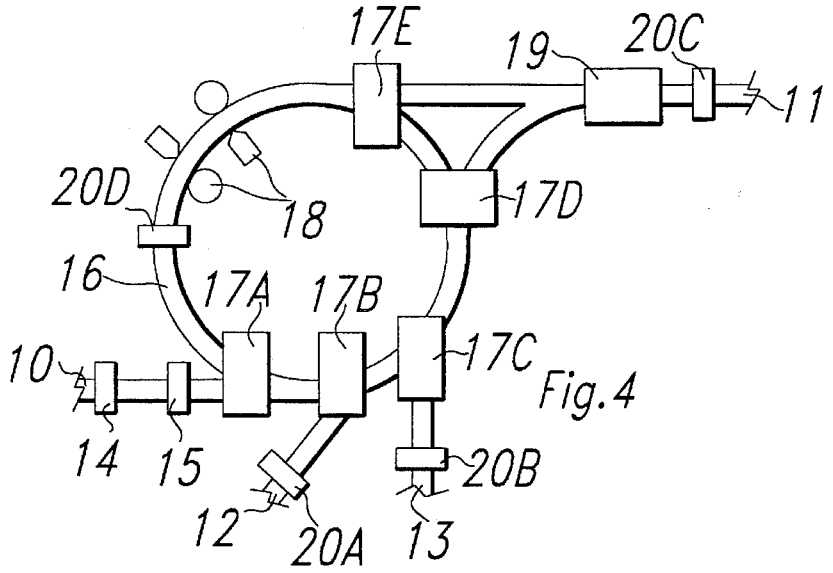
FIG. 4 is a principle diagram which shows one side of the gate reader 8 in FIG. 3 and illustrates the latchable infeed opening 10, the outfeed openings 11, 12 and 13, two reading forks 14, a reading fork 15, a dividable ticket cylinder 16, ticket switching devices 17A, 17B, 17C, 17D, 17E, a read unit 18, a document divider 19 and read forks 20A, 20B, 20C, 20D. The read unit 18 is comprised of a first part which functions to read the ATB-ticket (1) when the ticket is inserted into the gate reader (8) with the magnetic strip (2) facing upwards, and a second part which functions to read the ATB-ticket (1) when said ticket is inserted into the gate reader (8) with the magnetic strip (2) facing downwards. Each such read-unit part is, in turn, comprised of two read heads and two counter-pressure de-vices which although preferably immovable may also have the form, e.g., of slide shoes or rollers. That part of a counter-pressure device which is located adjacent a read head will have a radius which is generally equal to the radius of the ticket cylinder 16.
Figure 5:
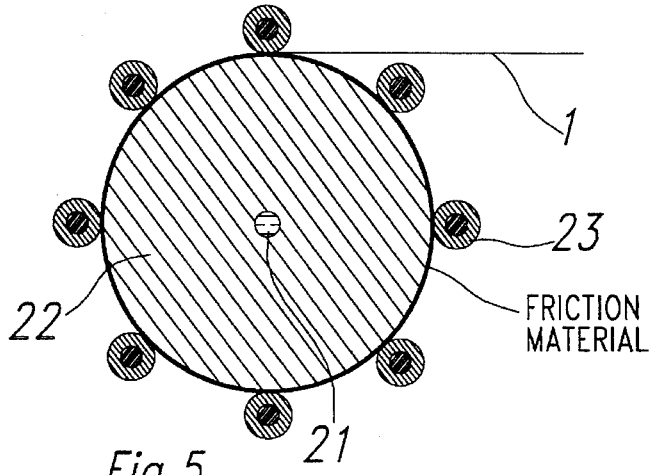
FIG. 5 is a side view of the ATB-ticket 1 and the dividable ticket cylinder 16, which is formed by the generally cylindrical space defined inwardly by a drive wheel 22 provided with a drive shaft 21, and outwardly by counter-pressure rollers 23 and the aforesaid ticket switching devices, here referenced 17A, 17B, 17C, 17D, 17E, said counter-pressure rollers preferably being arranged in pairs.

As will be evident from the aforegoing, continued treatment or processing of the ticket 1 is determined subsequent to the ticket having reached step f) in FIG. 2.

The following step g) is carried out with the exception of the following step i) when the ticket 1 has been inserted in the earlier described, preferred fashion:

g) The ticket 1 is advanced anti-clockwise until its trailing edge passes the thin part of the switch 17E, whereafter the ticket is advanced clockwise out over the switch 17E. When the ticket 1 reaches the document divider 19, the ticket is divided into a flight coupon 6, with attached binding stub 5, and a boarding pass 7. The boarding pass 7 is advanced out through the outfeed opening 11. The flight coupon 6 with attached binding stub 5 is moved back to the ticket cylinder 16 and is then discharged through the outfeed opening 12 over the switch 17B, or through the outfeed opening 13 over the switch 17C. The gate reader 8 then returns to its standby state.

If the ticket 1 has been inserted in some other way, with the following exception i), the following step h) is carried out:

h) The ticket 1 is fed anti-clockwise out towards the document divider 19, over the switch 17D. The different parts of the ticket 1 are then advanced in the manner described in step g). The gate reader 8 then returns to its standby state.

In certain particular instances, the ticket 1 can be treated in accordance with the following step i):

i) The ATB-ticket 1 is advanced anti-clockwise until its trailing edges passes the thin part of the switch 17E, whereafter the ticket is moved clockwise over the switch 17E and out through the outfeed opening 11 without being divided. The reader 8 then returns to its standby state.

It will be obvious that different variants of the aforedescribed gate reader 8 are included within the scope of the inventive concept. For example, more or fewer switches than those described and illustrated may be mounted adjacent the dividable ticket cylinder 16. The number of document outfeed paths may also be more or fewer than three. The gate reader 8 may also be provided with means for transferring to the record medium on the ticket data which can be read magnetically, optically or in some other way. Furthermore, other ticket outfeed or discharge variants than those described and illustrated are also embraced by the inventive concept.

I claim:

1. Apparatus for automatically printing, reading and otherwise treating tickets and other documents having provided thereon an information carrier which carries data that can be read magnetically, optically or in some other way, said apparatus being useful for reading and otherwise processing ATB-tickets (1) at airport gates, called gate readers (8), wherein the tickets (1) have a magnetic strip (2) provided on one side thereof, called the rear side, and lack an information carrier on the other side thereof, called the front side, and have a first set of perforations (3) and a second set of perforations (4) which respectively divide the ticket (1) into a binding stub (5), a flight coupon (6) and a boarding pass (7), or into separate boarding passes (7), said gate reader (8) having at least one latchable ticket insertion opening (10) ad at least three ticket outfeed openings (11, 12, 13), characterized in that for the purpose of handling an ATB-ticket (1) or some other document provided with an information carrier on which data can be entered and read magnetically, optically or in some other way with the ticket moving in a circular pathway, the gate reader (8) includes a cylindrical ticket cylinder (16) which can be divided readily in a plane which passes through its center lines and in which the ticket (1) or some other document provided with an information carrier in which data can be inserted and read magnetically, optically or in some way, is able to move both clockwise and anti-clockwise; and in that there is provided inwardly of at least one of the ticket outfeed openings (11, 12, 13) a document divider (19) which functions to separate the boarding pass (7) from the remainder of the ticket (1), said ticket cylinder (16) is comprised of the generally cylindrical space which is defined inwardly by a drive wheel (22) having a drive shaft (21), and outwardly by counter-pressure rollers (23); in that the drive shaft (21) is journalled in a dividable bearing housing (9F); in that for the purpose of obtaining a dividable ticket cylinder (16) a first cog wheel (9D) is mounted in the body of the gate reader (8) and a second cog wheel (9E) is mounted on one side of the drive wheel (22) concentrically with said drive shaft (21), said two cog wheels (9D, 9E) meshing with one another when, and only when, the drive wheel (22) is not separated from the apparatus in general; in that mounted in the gate reader (8) is a drive motor (9A) which functions to drive the first cog wheel (9D) through the medium of a drive belt (9C), such that when the dividable bearing housing (9F) is separated from the remainder of the apparatus, a number of the aforesaid counter-pressure rollers (23) will accompany the uplifted part of the gate reader (8), whereas the drive wheel (22) with the second cog wheel (9E) attached thereto can be removed from the gate reader (8) without difficulty.

2. Apparatus according to claim 1, characterized in that the apparatus also includes one or more devices for transferring to a information carrier data that can be read magnetically, optically or in some other fashion.

3. Apparatus according to claim 1, characterized in that when seen in cross-section through the drive shaft (21), the drive wheel (22) has the form of two mutually opposed H's.

4. Apparatus according to claim 3, characterized in that side surfaces of the drive wheel (22) are provided with a frictional lining, such as vulcanized polyurethane, which functions to support eh ATB-ticket (1) when the ticket is located in the ticket cylinder (16).

5. Apparatus according to claim 3, characterized in that mounted between the ticket insertion opening and the ticket cylinder are two first read forks which function to verify that a document inserted into the opening has an acceptable width, a second read fork which together with the first read forks checks whether or not an inserted document conforms with tolerance requirements established with regard to physical measurements and also checks whether or not the document moves correctly in the ticket cylinder, has fastened or is held fast or has been discharged out through the ticket insertion opening, three third read forks which verify that all ticket parts fed into the ticket cylinder are discharged therefrom, and a fourth read fork which determines the position of the ATB-ticket in the ticket cylinder.

6. Apparatus according to claim 3, characterized in that mounted adjacent the drive wheel is a read unit which functions to read data from the magnetic strip irrespective of how the ticket is inserted into the gate reader, said read unit including a first part which functions to read the ticket when the ticket inserted into the gate reader with the magnetic strip facing upwards, and a second part which functions to read the ticket when the ticket is inserted into the gate reader with the magnetic strip facing downwards, said two read unit parts, each comprising two read heads and two counter-pressure devices, these latter devices being immovable but also capable of being comprised, for instance, of slide shoes or rollers, wherein that part of one said counter-pressure device that is located adjacent one read head having generally a radius which is equal to the radius of the ticket cylinder, and in that given counter-pressure rollers are mounted adjacent the indeed region of the read unit.

7. Apparatus according to claim 3, characterized by ticket switching devices which are mounted adjacent the drive wheel and function to assist in the discharge or outfeed of the ticket or the discharge or outfeed of a ticket-part from the ticket cylinder.

8. Apparatus according to claim 2 characterized in that mounted between the ticket insertion opening (10) and the ticket cylinder (16) are two first read forks (14) which function to verify that a document inserted into the opening (10) has an acceptable width, a second read fork (15) which together with the first read forks (14) checks whether or not an inserted document conforms with tolerance requirements established with regard to physical measurements and also checks whether or not the document moves correctly in the ticket cylinder (16), has fastened or is held fast or has been discharged out through the ticket insertion opening (10), three third read forks (20A, 20B, 20C) which verify that all ticket parts fed into the ticket cylinder (16) are discharged therefrom, and a fourth read fork (20D) which determines the position of the ATB-ticket (1) in the ticket cylinder (16).

9. Apparatus according to claim 1, characterized in that mounted adjacent the drive wheel (22) is a read unit (18) which functions to read data from eh magnetic strip (2) irrespective of how the ticket (1) is inserted into the gate reader (8), said read unit (18) including a first part which functions to read the ticket (1) when the ticket inserted into the gate reader (8) with the magnetic strip (2) facing upwards, and a second part which functions to read the ticket (1) when the ticket is inserted into the gate reader (8) with the magnetic strip (2) facing downwards, said two read unit parts, each comprising two read heads and two counter-pressure devices, these latter devices being immovable but also capable of being comprised, for instance, of slide shoes or rollers, wherein that part of one said counter-pressure device that is located adjacent one read head having generally a radius which is equal to the radius of the ticket cylinder (16), and in that given counter-pressure rollers (23) are mounted adjacent the indeed region of the read unit (18).

10. Apparatus according to claim 9, characterized in that each of the read heads in the read unit (18) is mounted on said unit (18) in a manner such as to maintain between a read head and its corresponding counter-pressure device a distance which is slightly smaller than the thickness of an ATB-ticket (1) in the absence of a ticket (1) between said read head and its corresponding counter-pressure device, and which distance is increased by an ATB-ticket (1) as said ticket passes between said read head and said corresponding counter-pressure device; in that said read-head mounting is so constructed, that said distance cannot be made smaller than a predetermined value.

11. Apparatus according to claim 2 characterized by ticket switching devices (17A, 17B, 17C, 17D, 17E) which are mounted adjacent the drive wheel (22) and function to assist in the discharge or outfeed of the ticket (1) or the discharge or outfeed of a ticket-part from the ticket cylinder (16).

12. Apparatus according to claim 11, characterized in that each of the ticket switching devices (17A, 17B, 17C, 17D, 17E) is mounted on the throughpassing shaft of a respective counter-pressure roller (23); in that at least those counter-pressure rollers (23) on which the ticket switching devices (17A, 17B, 17C, 17D, 17E) are mounted is each comprised of two part-rollers which are mounted on a common shaft and which have a mutual spacing and are respectively placed generally centrally opposite each side of the drive wheel (22); and in that each of the ticket switching devices (17A, 17B, 17C, 17D, 17E) is positioned between corresponding part-rollers.

13. Apparatus according to claim 12, characterized in that mutually counter-directed ticket switching devices (17D, 17E) are mounted commonly on one and the same shaft of one of the counter-pressure rollers (23).

14. Apparatus according to claim 11 characterized in that each of the ticket switching devices (17A, 17B, 17C, 17D, 17E) has the shape of a wing cross-section having a thickest part through which the shaft of a counter-pressure roller (23) extends; in that said thickest part of each of the ticket switching devices (17A, 17B, 17C, 17D, 17E) protrudes slightly beyond the counter-pressure roller (23); in that the side of each of said ticket switching device (17A, 17B, 17C, 17D, 17E) facing towards the drive wheel (22) has generally the same radius as the drive wheel (22); in that the thinner end of each the ticket switching devices (17A, 17B, 17C, 17D, 17E) is slightly narrower than each of the thickest parts of said ticket switching devices (17A, 17B, 17C, 17D, 17E); in that the length dimension of each of the ticket switching devices (17A, 17B, 17C, 17D, 17E) is such that when each of said ticket switching devices (17A, 17B, 17C, 17D, 17E) is swung outwards away from the drive wheel (22), the thinner end of each said device will strike against the nearest counter-pressure roller (23), or against the nearest of the ticket switching devices (17A, 17B, 17C, 17D, 17E) in a manner such that the underside thereof will be generally concentrical with the drive wheel (22); and in that the radial depth of the space located between the aforesaid friction linings on the drive wheel (22) is at least equal to the thickness of the ticket (1) plus the thickness of the aforesaid thinner parts of respective ticket switching devices (17A, 17B, 17C, 17D, 17E).

15. Apparatus according to claim 14, characterized in that the ticket switching devices (17A, 17B, 17C) are held in a position, a so-called rest position, in which each of the thinner ends of respective ticket switching devices (17A, 17B, 17C) are held inwardly of the mantle surface of the drive wheel (22) with the aid of a spring (24), which may be incorporated in the thickest end of each respective switching device and there supports against a pin (25) firmly anchored in the rotational shaft of the corresponding switching device, or may be mounted on one end, or on both ends of respective carrier shafts of the ticket switching devices (17A, 17B, 17C), said spring (24) being compressed when an ATB-ticket (1) is urged against the underside of the corresponding switching device, said device being moved to a position, a working position, in which the underside of said device is concentrical with the drive wheel (22).

16. Apparatus according to claim 14, characterized in that given ticket switching devices (17D, 17E) are counter-directional and are mounted on one and the same counter-pressure roller shaft and therewith are comprised of two components or of one single indivisible unit; in that one, (17E), of said switching devices is held in a position, a rest position, in which its thinner end is located inwardly of the mantle surface of the drive wheel (22), with the aid of a particularly configured spring which is incorporated in the thickest end of the switching device and which then supports against a pin (25) firmly mounted on the rotational shaft of said one switching device (17E), or which may be mounted on one end, or both ends, of the carrier shaft of said one device (17E), said spring being compressed when an ATB-ticket (1) is pressed against the underside of said one switching device (17E), wherein said one switching device is moved to a position, a working position, in which its underside is concentrical with the drive wheel (22); in that a further, (17D), of said switching devices has a rest position in which its thinner end is located externally of the mantle surface of the drive wheel (22), this further switching device being held in said position by a spring; and in that the further switching device (17D) can be moved to a position, a working position, in which its thinner end is located inwardly of the mantle surface of the drive wheel (22) by means of a magnetic coil mounted on the further switching device (17D).

17. Apparatus according to claim 11 characterized in that the read forks (14, 15), the ticket switching device (17A, 17B, 17C, 7D, 17E), the read unit (18), the read fork (20D), the drive wheel (22) and the counter-pressure rollers (23) are so constructed and mounted that together they form a preferred embodiment of the ticket cylinder (16), which is therewith surrounded by a continuous and removeable circular inner pathway and a continuous and dividable or separable circular outer pathway between which two pathways the ATB-ticket (1) will pass provided that it is located in the ticket cylinder (16), said ticket cylinder (16) lacking a continuous outer casing.

18. A method for handling or processing a document with the aid of apparatus according to claim 11, characterized by carrying out the following steps:

a) An apparatus for automatically printing, reading and otherwise treating tickets and other documents having data which can be inserted into and read from a information carrier magnetically, optically or in some other way, particularly apparatus for reading and otherwise processing ATB-tickets (1) at airport gates, so-called gate readers (8), are brought to a standby state in readiness for the insertion of an ATB-ticket (1) or some other authentic ticket, primarily a separate boarding pass (7).

b) Starting the working cycle of the gate reader (8) when a correct or authentic ticket is located in a ticket insertion opening (10) of the gate reader (8) and transporting said ticket into said gate reader (8).

c) Establishing the length dimension of said ticket so as to determine the type of document that has been inserted, wherewith documents of unacceptable length dimensions are returned through the ticket insertion opening (10).

d) When the ticket has an acceptable length, sending a start command to a read unit (18) mounted adjacent a drive wheel (22) which in turn is mounted adjacent a ticket cylinder (16) belonging to the gate reader (8) so as to read data from a magnetic strip (2) mounted on one side of the ticket driven by a drive wheel (22) having a drive shaft (21), said ticket being advanced past the read unit (18) while data is read therefrom.

e) Comparing data taken from the magnetic strip (2) with data earlier inserted into a main control system with the aid of said system, said ticket being returned to the ticket insertion opening (10) when the ticket comparison is found unsatisfactory.

f) Continuing the processing of said ticket in accordance with one of the following steps g), h) or i) when the aforesaid comparison is found satisfactory.

g) Advancing the ticket anti-clockwise until the trailing edge of said ticket passes the thinner edge of a ticket switching device (17E) mounted adjacent the drive wheel (22) and then advancing the ticket clockwise and feeding said ticket out over the switching device (17E) wherein a document divider (19) positioned inwardly of at least one ticket outfeed opening (11, 12, 13) belonging to the gate reader such as to divide the ticket into a flight coupon (6) with an attached binding stub (5) and a boarding pass (7), whereafter the boarding pass (7) is advanced out through a first ticket outfeed opening (11) while the flight coupon (6) with attached binding stub (5) is moved back to a ticket cylinder (16) arranged in the gate reader (8) and discharged through a second ticket outfeed opening (12) over a second ticket switching device (17B) or through a third ticket outfeed opening (13) over a third ticket switching device (17C), whereafter the gate feeder (8) returns to its standby state.

h) Feeding said ticket anti-clockwise out towards the document divider (19) over a fourth switching device (17D), wherewith the document divider (19) separates the flight coupon (6) with attached binding stub (5) from the boarding pass (7), whereafter the boarding pass (7) is advanced out through the first ticket outfeed opening (11) while the flight coupon (6) with attached binding stub (5) is moved back to the ticket cylinder (16) and discharged out through the second ticket outfeed opening (12) over the second ticket switching device (17B) or through the third ticket outfeed opening (13) over the third ticket switching device (17C), whereafter the gate reader (8) returns to its standby state.

i) Advancing said ticket anti-clockwise until its trailing edge passes the thinner part of a fifth switching device (17E) and then advancing the ticket clockwise over the fifth switching device (17E) and out through the first outfeed opening (11) without dividing the ticket, whereafter the gate reader (8) returns to its standby state.

19. Apparatus for automatically printing, reading and otherwise treating tickets and other documents having provided thereon an information carrier which carries data that can be read magnetically, optically or in some other way, said apparatus being useful for reading and otherwise processing ATB-tickets (1) at airport gates, called gate readers (8), wherein the tickets (1) have a magnetic strip (2) provided on one side thereof, called the rear side, and lack an information carrier on the other side thereof, called the front side, and have a first set of perforations (3) and a second set of perforations (4) which respectively divide the ticket (1) into a binding stub (5), a flight coupon (6) and a boarding pass (7), or into separate boarding passes (7), said gate reader (8) having at least one latchable ticket insertion opening (10) and at least three ticket outfeed openings (11, 12 13), characterized in that for the purpose of handling an ATB-ticket (1) or some other document provided with an information carrier on which data can be entered and read magnetically, optically or in some other way with the ticket moving in a circular pathway, the gate reader (8) includes a cylindrical ticket cylinder (16) which can be divided readily in a plane which passes through its center line and in which the ticket (1) or some other document provided with an information carrier in which data can be inserted and read magnetically, optically or in some other way, is able to move both clockwise and anti-clockwise; and in that there is provided inwardly of at least one of the ticket outfeed openings (11, 12, 13) a document divider (19) which functions to separate the boarding pass (7) from the remainder of the ticket (1); said document divider (19) is mounted adjacent the ticket cylinder (16) and is provided with an immovable, sharp ticket-dividing edge and includes a pressing device and is also constructed so as to assist in separating the boarding pass (7) from the remainder of the ATB-ticket (1) in the following fashion:

An instruction is issued by a main control system to divide the ticket (1)*d*, whereupon the ticket is partially extended from the ticket cylinder (16) through a slot or some other opening provided adjacent said dividing edge of the ticket divider (19) and wherein said ticket can be extended through the slot both when the ATB-ticket (1) moves clock wise and when the ticket moves anti-clockwise in the ticket cylinder (16).

Extension of the ticket through said slot is stopped when a pre-perforation, embossment or some other dividing indication on the ticket (1) is located a short distance from said dividing edge of the document divider (19).

The ATB-ticket (1) is folded by means of said pressing device along said pre-perforation, embossment or like dividing indication through an angle greater than 90 degrees and in a direction towards said dividing edge and is there held in a folded state by means of the pressing device.

The ATB-ticket (1) is fed into the ticket cylinder (16) in a direction opposite to the direction in which said ticket was partially extended through said slot, said pre-perforation, embossment or like dividing indication being moved against said dividing edge such as to effect division of the ticket (1) as close as possible to the pre-perforation, embossment of like ticket-dividing indication, said dividing edge preferably being angled so as to lie against the pre-perforation, embossment or like ticket-dividing indication at only one single point which moves along said pre-perforation, embossment or like ticket-dividing indication as the ticket (1) is divided, so as to effect division of the ticket with the smallest possible force.

20. A document reading and processing device, comprising:

a document inlet to which a document having an information carrier or record medium is inserted;

a width determining mechanism for determining correct document insertion;

a length determining mechanism for determining the type of document inserted;

transport means for transporting said document from said document inlet to a cylindrical document cylinder;

reading means for reading information recorded on said document, said reading means being formed of at least one reading head on opposing sides of said document cylinder;

a document divider coupled to said cylindrical document cylinder for dividing said document into at least two parts; and transport means for transporting said document from said cylindrical document cylinder to said document divider and for transporting at least one part of said document from said document divider back to said cylindrical document cylinder.

21. The document reading and processing device of claim 20 wherein said information carrier or record medium is a magnetic strip.

22. The document reading and processing device of claim 20 wherein said width determining mechanism comprises two read forks.

23. The document reading and processing device of claim 20 wherein said length determining mechanism functions is a read fork which measures the length of the document.

24. The document reading and processing device of claim 23 wherein said length of the document is measured primarily in order to ascertain where or not the document inserted is a complete document or a separated portion of said document.

25. The document reading and processing device of claim 24 wherein said length measuring function is also used to prevent the insertion of erroneous and irrelevant documents.

26. The document reading and processing device of claim 20 wherein said document may be moved clockwise and anti-clockwise within said cylindrical document cylinder.

27. The document reading and processing device of claim 20 wherein said document is stopped when a pre-perforation, embossment or some other document dividing mark on the document is located at a dividing edge of said document divider.

28. The document reading and processing device of claim 27 wherein said document is divided at said pre-perforation, embossment or some other document dividing mark on the document.

29. The document reading and processing device of claim 20 further including at least one read fork in said cylindrical document cylinder for determining the location of the document within the cylinder.

30. The document reading and processing device of claim 20 wherein said cylindrical document cylinder can be separated or divided.

31. The document reading and processing device of claim 20 further including a latch which prevents the insertion of a document into the document inlet when another document is being handled or processed by the document reading and processing device.

32. The document reading and processing device of claim 20 wherein said cylindrical document cylinder comprises a generally cylindrical space which is defined inwardly by a drive wheel having a drive shaft, and outwardly by counter-pressure rollers.

33. The document reading and processing device of claim 30 wherein said cylindrical document cylinder comprises a generally cylindrical space which is defined inwardly by a drive wheel having a drive shaft, and outwardly by counter-pressure rollers, a number of said counter-pressure rollers accompanying the separable or dividable portion of the cylindrical document cylinder.

34. The document reading and processing device of claim 32 wherein the drive shaft is journalled in a dividable bearing housing.

35. The document reading and processing device of claim 34 further including a first cog wheel mounted in the body of the document reading and processing device and a second cog wheel mounted on one side of the drive wheel concentrically with said drive shaft, said two cog wheels meshing with one another, and a drive motor which functions to drive the first cog wheel through the medium of a drive belt.

36. The document reading and processing device of claim 20 wherein said document is a ticket.

37. A method of reading and processing a document having an information carrier or record medium, comprising:

inserting said document into a document inlet;

determining the width of said document for verifying correct document insertion;

determining the length of said document to determine the type of document inserted;

transporting said document from said document inlet to a cylindrical document cylinder;

reading the information recorded on said document regardless of document orientation, said reading being performed by one of at least one reading head on opposing sides of said document cylinder;

transporting said document from said cylindrical document cylinder to a document divider, dividing said document regardless of document orientation, and transporting at least one part of said document from said document divider back to said cylindrical document cylinder.

* * * * *